US007343946B2

(12) United States Patent
Stager

(10) Patent No.: US 7,343,946 B2
(45) Date of Patent: Mar. 18, 2008

(54) HIGH SPEED PLANER HEAD

(75) Inventor: Bradley R. Stager, Beaverton, OR (US)

(73) Assignee: Key Knife, Inc., Tualatin, OR (US)

( * ) Notice: Subject to any disclaimer, the term of this patent is extended or adjusted under 35 U.S.C. 154(b) by 150 days.

(21) Appl. No.: 10/802,582

(22) Filed: Mar. 16, 2004

(65) Prior Publication Data

US 2005/0205162 A1 Sep. 22, 2005

(51) Int. Cl.
*B27C 1/00* (2006.01)

(52) U.S. Cl. ..... 144/176; 144/229; 144/230; 144/241; 407/53; 407/62

(58) Field of Classification Search ..... 144/240, 144/241, 218, 221, 176, 230, 228, 229; 407/53, 407/54, 61, 62, 113; 409/228
See application file for complete search history.

(56) References Cited

U.S. PATENT DOCUMENTS 1,830,813 A 11/1931 Tautz
3,467,416 A 9/1969 Gourley
3,613,197 A * 10/1971 Stier ..... 407/113
3,742,564 A 7/1973 Boboltz et al.
3,887,975 A * 6/1975 Sorice et al. ..... 407/47
4,169,690 A * 10/1979 Kendra ..... 407/90
4,667,713 A * 5/1987 Wright ..... 144/231
5,100,070 A * 3/1992 Montgomery, Sr. ..... 241/294
5,183,089 A * 2/1993 Norlander et al. ..... 144/231
5,188,488 A * 2/1993 Nakayama et al. ..... 407/54
5,201,352 A * 4/1993 Hult ..... 144/218
5,368,077 A 11/1994 Croghan et al.
5,741,095 A * 4/1998 Charron et al. ..... 407/42
5,779,167 A * 7/1998 Wagstaff ..... 241/242
5,819,826 A 10/1998 Schmatjen (Continued)

FOREIGN PATENT DOCUMENTS

EP 0005906 12/1979
EP 0 566 858 A 10/1993

OTHER PUBLICATIONS

High Speed Planer Adjustment Manual.

(Continued)

*Primary Examiner*—Bena Miller
(74) *Attorney, Agent, or Firm*—Portland Intellectual Property, LLC

(57) ABSTRACT

A high speed planer head. Disclosed according to one aspect of the invention is a hub and a threaded member. The hub is axially disposed for rotation about an axis, and has a pocket for receiving a first knife against a supporting wall of the pocket. The threaded member has a frustoconical ramping portion for producing a wedging force against the knife when the threaded member is threaded into a threaded hole in the hub. According to another aspect of the invention, a second hub for carrying a second knife is provided, the second hub preferably being bolted to the first hub to that the hubs can be disassembled. The second knife preferably has two linear cutting edges and the second knife preferably has at least two curvilinear cutting edges and more preferably has four concave, semi-circular cutting edges that are spaced apart from one another with 90 degree rotational symmetry.

19 Claims, 14 Drawing Sheets

U.S. PATENT DOCUMENTS

| | | | | |
|---|---|---|---|---|
| 5,974,922 | A * | 11/1999 | Camp et al. | 83/37 |
| 6,168,104 | B1 | 1/2001 | Lin et al. | |
| 6,474,210 | B1 | 11/2002 | Nel et al. | |
| 6,688,351 | B2 * | 2/2004 | Stager et al. | 144/373 |
| 6,846,135 | B2 * | 1/2005 | Kuroda et al. | 407/53 |

OTHER PUBLICATIONS

Pallman Model KW-16 Rotor "Messeraufnahme" Diagram.
EPO Partial European Search Report dated Jun. 23, 2005, pp. 1-4.
EPO European Search Report with Annex dated Jun. 23, 2005, pp. 1-4.
EPO Partial European Search Report dated Jun. 23, 2005, pp. 1-4.
EPO European Search Report with Annex dated Jun. 23, 2005, pp. 1-4.

* cited by examiner

HIGH SPEED PLANER HEAD

FIELD OF THE INVENTION

The present invention relates to a high speed planer head, such as for use in commercial manufacturing of construction lumber and finished wood products.

BACKGROUND

The finish on construction lumber, such as cut from logs into 2×4, 2×6, 2×12, and 4×4 nominal dimensions, has become increasingly important as a result of the trend for such construction lumber to be sold in retail outlets, such as the large home improvement chain stores, to "do-it-yourself" (DIY) consumers. While construction lumber is typically covered with sheet rock or gypsum board and so is not visible in finished construction, DIY consumers often select and purchase construction lumber primarily on the basis of surface finish. Accordingly, well finished construction lumber can command a premium price, and construction lumber that is not well finished may be difficult to sell.

Commercial planer heads include a plurality of elongate knives spaced circumferentially on a cylindrical hub rotating at high speed. The elongate axes of the knives are typically, but not necessarily, aligned with the axis of rotation. The wood travels relative to the head in a direction perpendicular to the axis of rotation of the hub, the knives cutting a surface on the wood. The resulting surface finish is affected by a number of factors, e.g., the extent to which the planer head is in balance, the density of knives on the planer head, the speed of rotation, the speed of travel of the wood, and the ability of the apparatus to efficiently keep chips away from the cutting surface as it is being cut.

Standard practice provides for statically balancing the knives and knife assemblies carried by the hub as well as dynamically balancing the hub and the shaft to which the hub is attached (or with which the hub is integrally formed). The speed of rotation of the head is set as high as practical, and the speed of travel of the wood is set as high as possible while still providing acceptable surface finish, to increase the speed of production. Some "chip marks" occur as a result of chips remaining on the cutting surface as the wood is being cut and have been accepted in the prior art.

With a given degree of balancing and speed of rotation of the planer head, increasing the speed of wood travel to obtain further efficiency increases will decrease the quality of the surface finish, and it would be advantageous either to be able to increase the speed while maintaining the quality of surface finish, or maintain the speed and improve the quality of the surface finish.

One means for increasing the surface quality given the limitations noted above is to increase the frequency of cutting by increasing the density of knives on the planer head. Particularly, the parallel and circumferentially distributed cutting edges of the knives should be spaced as close together as possible. However, each knife must be removable so that the knife can be sharpened or replaced. The knives are typically clamped in knife assemblies by screws. The screws may bear on a block of metal called a "gib" that it turn bears on the knife, the end of the screw may bear directly on the knife, or the screw may extend into a collar that wedges against the knife. In all cases, the construction methodology places limits on the potential for increasing the density of the knives.

Typically, prior art knives have a straight cutting edge and one or two radiused or semi-circularly curved cutting edges at respective ends of the straight cutting edge. Where only one curved cutting edge is employed, the knives are alternated in upside-down and right-side-up position so that two knives together cut respective opposite corners of the wood and each knife cuts the straight face of the wood so that the straight face of the wood is twice cut. In either case, a straight cutting edge is physically merged with a curved cutting edge. In a process known as "jointing," used for sharpening the knives as the knives are installed in the planer head and as the head is rotating, wherein a fixed stone is introduced against the rotating knives, what is known in the art as "relief" is lost for the outer portions of the curved cutting edges. This lack of relief results in hammering the wood at the corners, degrading surface finish.

Another problem in the prior art is adjusting the planer head between cutting an article of wood from green wood stock to cutting an article of the same nominal size from dry wood stock, and vice-versa. This has required replacing the complete planer head, which is costly.

There is a need, therefore, for a high speed planer head provided according to the present invention that solves the aforementioned problems and provides additional features and advantages.

SUMMARY OF THE INVENTION

The invention disclosed herein is a high speed planer head. According to one aspect of the invention a hub and a threaded member are provided. The hub is axially disposed for rotation about an axis and has a pocket for receiving a first knife against a supporting wall of the pocket. The threaded member has a frustoconical ramping portion for producing a wedging force against the knife when the threaded member is threaded into a threaded hole in the hub.

According to another aspect of the invention, a second hub for carrying a second knife is provided, the second hub preferably being bolted to the first hub to that the hubs can be disassembled. The first knife preferably has two linear cutting edges and the second knife preferably has at least two curvilinear cutting edges.

The second knife preferably has two linear cutting edges and the second knife preferably has at least two curvilinear cutting edges and more preferably has four concave, semi-circular cutting edges that are spaced apart from one another with 90 degree rotational symmetry.

DETAILED DESCRIPTION OF A PREFERRED EMBODIMENT

Figure 1A:
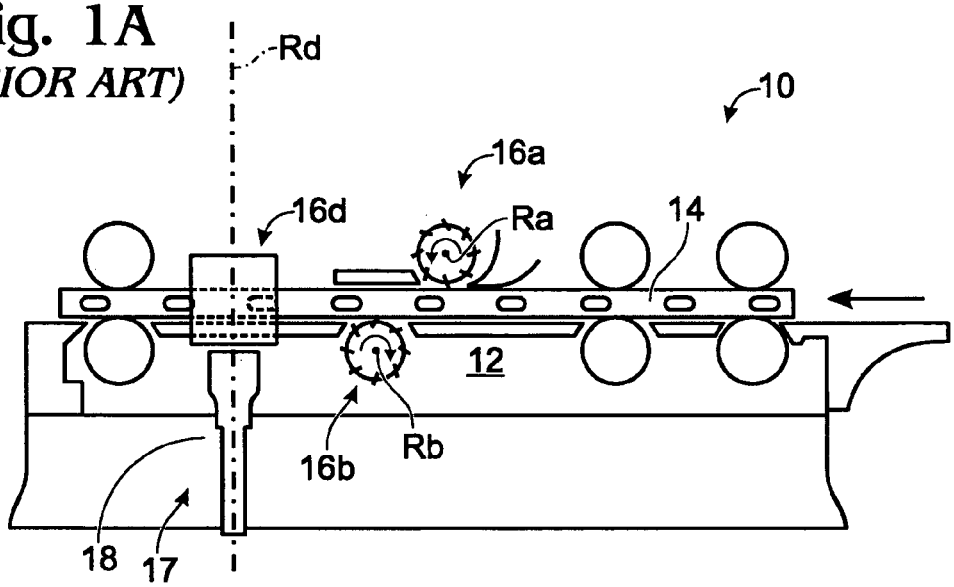
Fig. 1A (PRIOR ART)
FIG. 1A is side elevation of a prior art planing apparatus.
Figure 1B:
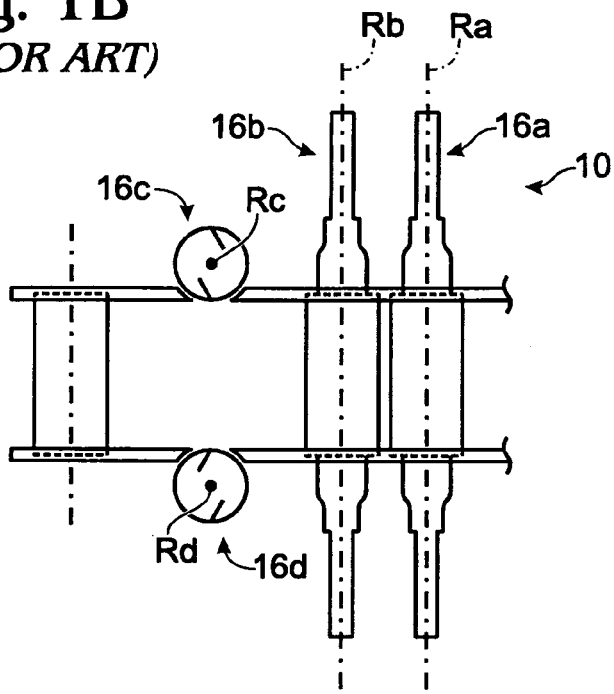
Fig. 1B (PRIOR ART)
FIG. 1B is a top view of the planing apparatus of FIG. 1A.

FIGS. 1A and 1B show two orthographic views (side and top, respectively) of a high speed planing apparatus 10. The apparatus 10 has a table 12 for supporting an article of wood 14 that travels horizontally on the table. At least four planer heads 16 are provided: one (16*a*) above the article of wood (hereinafter "top"), one (16*b*) below the article of wood (hereinafter "bottom"), one (16*c*) to one side of the article of wood and one (16*d*) to the other side of the article of wood (hereinafter "side"). Each planer head rotates about a respective axis of rotation "Ra," "Rb," "Rc," and "Rd." As a result of this rotation, in conjunction with travel of the wood 14 relative to the planer heads, each planer head cuts a corresponding surface on the article of wood, so that a top surface, a bottom surface, and two opposing side surfaces are cut. An object of this process is to produce a surface having a high surface quality; however, it is not essential that the planing apparatus be used to produce a finished surface.

Figure 2:
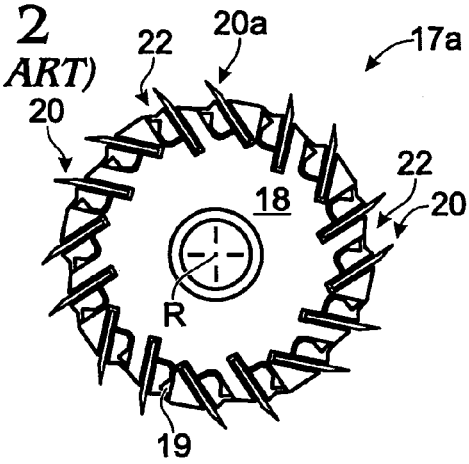
Fig. 2 (PRIOR ART)
FIG. 2 is an end view of a prior art planer head for use in the apparatus of FIGS. 1A and 1B.
Figure 3:
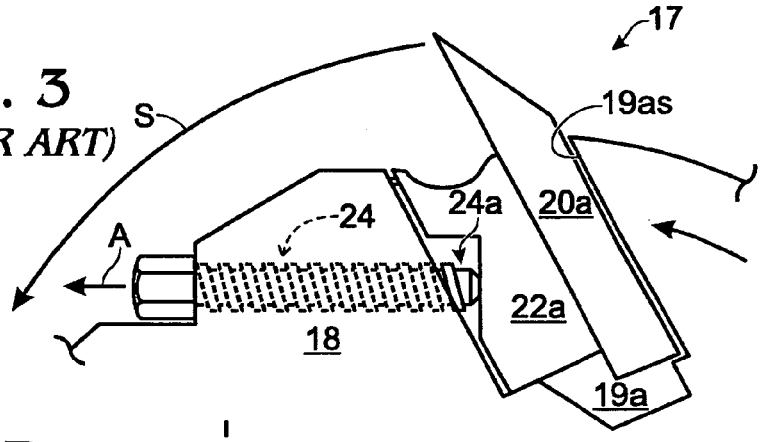
Fig. 3 (PRIOR ART)
FIG. 3 is more detailed end view of the planer head of FIG. 2.

FIG. 2 shows an end view of one (17*a*) of the planer heads 16. The head 17*a* has an axis of rotation "R." A hub 18 of the head 17*a* carries a plurality of circumferentially spaced apart knives 20 and associated gibs 22 in corresponding pockets 19 of the hub. FIG. 3 shows one of the pockets 19*a* in more detail. A knife 20*a* and its associated gib 22*a* are disposed in the pocket 19*a*. A screw 24 is threadably received through a hole in the hub 18 and a terminating end 24*a* thereof extends outside the hub and bears against the gib 22*a* which, in turn, bears against the knife 20*a*. This clamping force clamps the knife against a supporting wall 19 as of the pocket 19*a*. A minimum circumferential spacing "S" is required between adjacent knives to provide space for accessing and removing the screw 24*a* in the direction of the arrow "A."

Figure 4B:
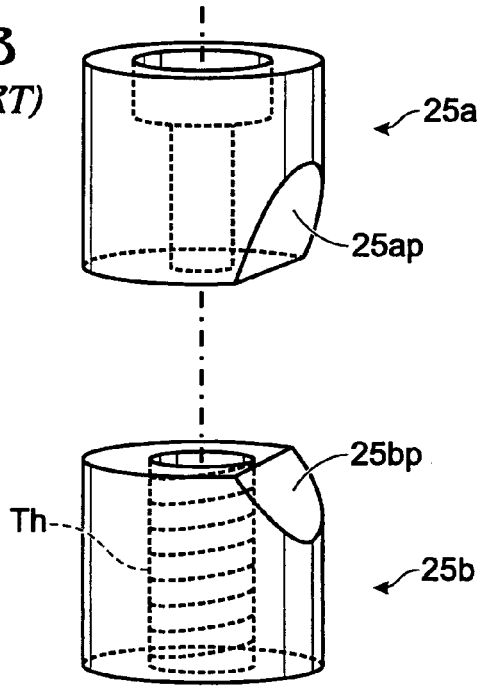
Fig. 4B (PRIOR ART)
FIG. 4B is a pictorial view of two collars used in the planer head of FIG. 4A.
Figure 4A:
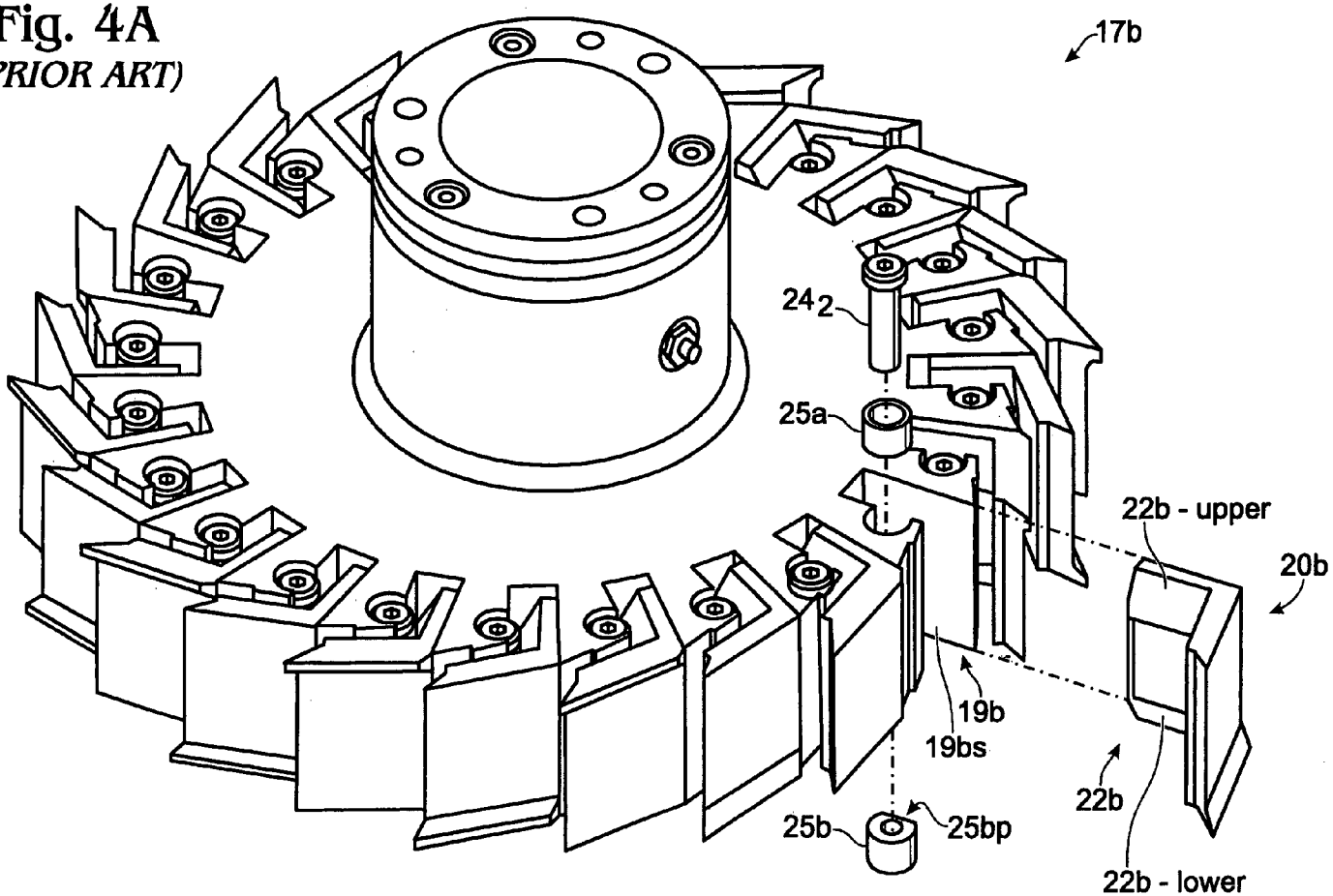
Fig. 4A (PRIOR ART)
FIG. 4A is a pictorial view of an alternative prior art planer head.

FIG. 4*a* is a pictorial view of an alternative prior art planer head 17*b*, showing a knife 20*b* removed therefrom. The knife 20*b* is clamped in a pocket 19*b* in the head 17*b* by an axially directed screw $\mathbf{24}_2$ extending through an upper collar 25*a* and into a corresponding lower collar 25*b*. Referring in addition to FIG. 4B, the collars 25 include corresponding ramped planar portions 25*ap* (not visible in FIG. 4A) and 25*bp* for mating with corresponding ramped planar portions 22*b*-upper and 22*b*-lower of a gib portion 22*b* of the knife 20*b* that functions analogously to the gib 22*a* of the knife 20*a*. Rather than bearing against the knife as does the gib 22*a*, the gib portion 22*b* is integrally attached to the knife and supports the knife, which is cantilevered therefrom. Therefore, the gib portion 22*b* must be particularly large and robust to withstand the required forces, as compared to the gib 22*a*.

One of the collars (25*a*) is adapted to receive the head of the screw $\mathbf{24}_2$ and the other collar (25*b*) includes threads "Th" adapted to receive the threads of the screw. Inserting the screw through the collar 25*a* and tightening the screw into the collar 25*b* forces the collars together, wedging the collars against the ramped planar portions of the knife and thereby forcing the knife against a back surface $\mathbf{19}b_s$ of the pocket 19*b*, to clamp the knife to the planer head. This construction provides an advantage over the planer head 17*a* described immediately above in providing the capability to move the knives closer to one another and therefore achieve denser knife spacing. However, this density is limited by the dimensions of the collars and the gib portions 22*b*, all of which must be robustly sized in order to withstand the required forces.

Figure 5:
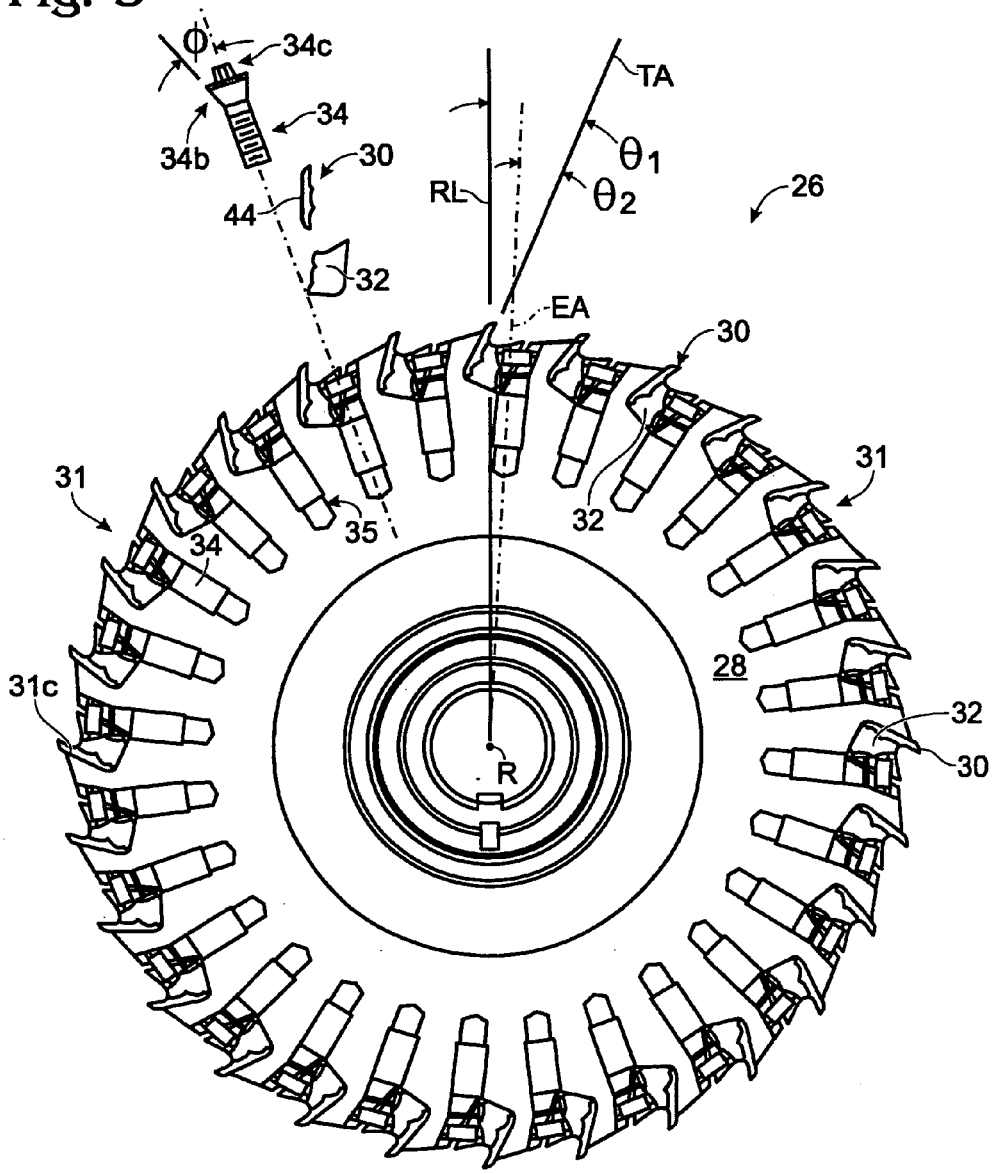
FIG. 5 is an end view of a face-cutting planer head according to the present invention.
Figure 6:
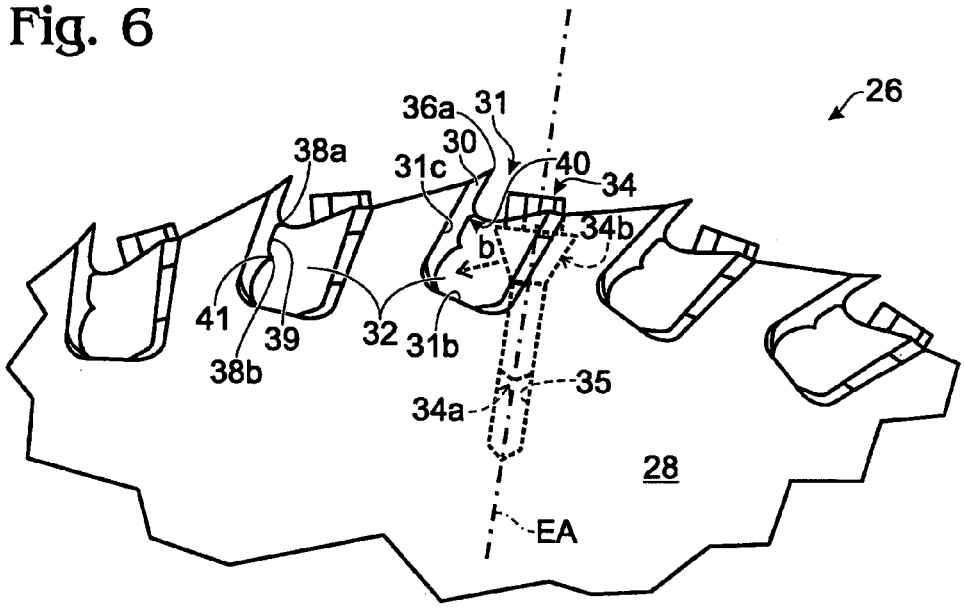
FIG. 6 is more detailed end view of the planer head of FIG. 5.

Turning to FIG. 5, an end view of a face-cutting planer head 26 according to the present invention is shown. A hub 28 of the head 26 carries a plurality of circumferentially spaced apart knives 30. Each knife 30 is disposed in an associated pocket 31 and has an associated gib 32. As best seen in FIG. 6, showing a portion of the periphery of the hub 28 in greater detail, a screw 34 has a threaded portion for threading into a hole 35 in the hub. The threaded portion terminates in a terminating end 34*a* that is, preferably, contained within the hub and, in any event, is not used to exert a force on either the gib or the knife. Rather, the screw 34 according to the present invention has a ramping shoulder portion 34*b* which in a preferred embodiment of the invention is of frustoconical shape. The ramping portion 34*b* exerts increasing wedging force (in the direction indicated by the arrow "b") against the gib 32 as the screw is tightened, the gib in turn transmitting this wedging force against the knife, to clamp the knife in place against a supporting wall 31*c* of the pocket 31, and against the gib, to force the gib against a front side 40 of the knife and a bottom 31*b* of the pocket 31. The screw 34 is shown with a male tightening member 34*c*; however, a female tightening member may also be used. Moreover, a female tightening member has been determined not to become loaded with wood waste during operation and the female configuration provides for greater clearance and so may, therefore, be preferable.

An angle Θ defines the ramp angle of the of the ramping portion 34*b* of the screw 34. This ramp angle provides a mechanical advantage in translating a tightening force applied to thread the screw into the hole 35 into a clamping force bearing against the gib and, in turn, the knife. A small ramp angle Θ increases the advantage; however, if the ramp angle Θ is too small, too little range of movement of the gib will be provided to accommodate manufacturing tolerances between the screw, gib and knife, along with the additional elastic compression of the parts necessary to exert the required clamping force. It has been found that the ramp angle Θ is preferably in the range of about 10-25 degrees.

The combination of the screw 34 and gib 32 clamp each knife 30 in the planer head 26. The gib 32 need be no more robust than the gib 22*a* described above in connection with the head 17*a*. The screw 34 in essentially incorporating the function of the collars 25 of the head 17*b* can be of smaller overall dimensions than the corresponding screw and collar combination, and the gib 32 need not be as strong and therefore may be smaller and, particularly, thinner than the corresponding gib portion 22*b*. Thence, the screw and gib according to the present invention provide minimum sized components for clamping knives in a planar head, providing for maximum density of spacing of the knives and, therefore, a maximum degree or quality of surface finish.

Figure 7:
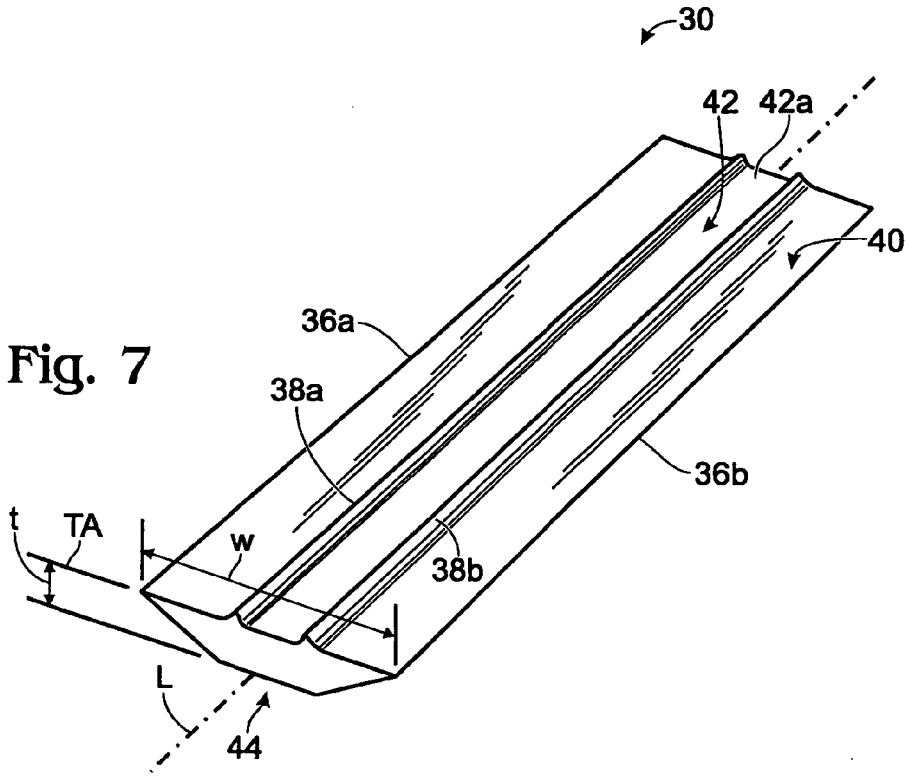
FIG. 7 is a pictorial view of a preferred knife for use in the planer head of FIG. 5.

Referring to FIG. 7, the knives 30 are preferably provided with dual, opposed, cutting edges 36*a* and 36*b* and corresponding deflector ridges 38*a* and 38*b* such as described in Schmatjen, U.S. Pat. No. 5,819,826 that project from the front side 40 of the knife and extend parallel to an elongate axis "L" of the knife. The deflector ridges define a channel 42 having a channel surface 42*a*. The channel 42 is effectively a recess in the front side of the knife, which may be provided in other configurations, such as a keyway. The knives 30 also have a back surface 44 that is received against the supporting wall 31*c* of the pocket 31.

The recess provided, in the preferred embodiment, by the deflector ridges 38 and the associated channel 42 define an interlocking feature adapted for interlocking with the gib 32, providing a double-sided, indexable knife system that securely and positively holds the knife in the associated pocket. Particularly, as seen in FIG. 6, for use with the preferred knife 30, the gib is adapted so that one of the deflector ridges 38*a* is disposed outside a toe 39 of the gib at one end of the toe, the other end of the toe being defined by a recess 41 shaped to receive the other deflector ridge 38*b*. The channel 42 as bounded by the deflector ridges defines a recess that, along with the relatively projecting toe of the gib 32, provide interlocking means which cooperate to index and further securely hold the knife 30 in position against the gib 32.

Referring back to FIG. 7, the knife 30 has an elongate axis "L" and, a line perpendicular to the elongate axis "L" and passing through the cutting edges 36 of the knife defines a transverse axis "TA" of the knife. Now referring back to FIG. 5, the gib 32 associated with the pocket wall 31*c* defines an orientation of the axis "TA" for the knife as installed in the hub 28. This orientation can be specified as an angle $\theta_1$ relative to a radial line "RL" extending through the axis of rotation "R" of the head. The angle $\theta_1$ establishes the axis "TA." The angle $\theta_1$ is optimized to provide a desired angle of attack for the knife and is preferably in the range of 10-30 degrees.

The hole 35 for receiving the threaded portion of the screw 34 has an elongate axis "EA" that makes an angle $\theta_2$ relative to the radial line "RL." The angle $\theta_2$ is optimized to direct the clamping force against the knife. The angle $\theta_2$ is preferably in the range of 10-20 degrees and is determined without regard to the angle $\theta_1$, i.e., the axes "EA" and "TA" rotate together as the angle $\theta_1$ is varied.

The planer head 26 provides several outstanding advantages. One advantage is that the manner described above for clamping each knife 30 provides for much denser spacing of the knives as compared to the prior art. The screw 34 may be accessed and removed from essentially a radial direction rather than a circumferential direction, so that the spacing between the knives need not provide space for screw access or removal as was required in the prior art. This denser spacing of the knives, by itself, improves surface finish. Moreover, this improved surface finish can be traded off, to any extent desired, to achieve higher production throughput by increasing the speed of travel of the wood being cut.

The mechanical advantage provided by the screw 34 has been found to decrease the number of screws required to achieve a given clamping force. This provides for less machine downtime, since fewer screws need to be loosened or removed in order to remove a knife for replacement or repair. This mechanical advantage also makes the screw less prone to loosening, so that clamping is made more secure.

It is also recognized by the present inventor that each of the knives 30 may be made very thin (dimension "t" in FIG. 7), so that, from material considerations, it becomes economical to dispose of the knives rather than repair them. For example, for a typical knife that is ⅞" wide (dimension "w" in FIG. 7) and arbitrarily long (e.g., anywhere from 1" to 48"), a representative dimension "t" is only 0.082". Employing disposable knives further reduces machine downtime as well as the cost of providing and operating machines used for knife repair. The ability to make the knives thin is due, at least in part, to the security of the clamping force provided by the screw 34 as well as the indexing provided by the deflector ridges.

The knives 30 and the gibs 32 need not extend the entire (axial) length of the hub 28. For example, two knives 30 and/or two associated gibs 32, axially butted against one another, are preferably used in each pocket 31, each pair of a knife and associated gib extending about half the axial length "l" of the hub. Two axially disposed knives and/or two axially disposed gibs, or more than two axially disposed knives and/or more than two axially disposed gibs may be provided in each pocket without departing from the principles of the invention.

Figure 8A:
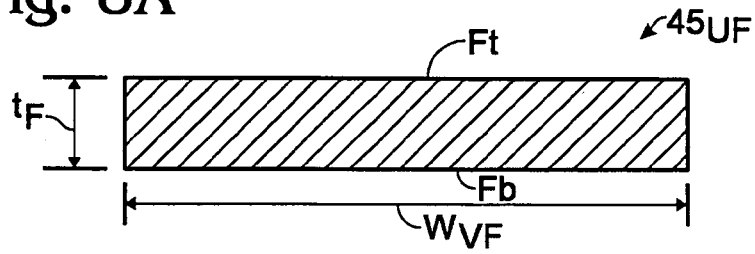
FIG. 8A is a cross-sectional view of an unfinished article of lumber.

The just described planer head 26 corresponds to two of the four planer heads 16*a*-16*d* of FIGS. 1A and 1B. Turning to FIG. 8A, a generalized cross-section of a length of unfinished construction lumber $\mathbf{45}_{UF}$ is shown. Two of the planer heads 26 are arranged in correspondence to the heads 16*a* and 16*b* of FIGS. 1A and 1B and cut, respectively, top and bottom faces $F_t$ and $F_b$ of the lumber $\mathbf{45}_{UF}$. After this cutting the lumber has a finished thickness "$t_F$," and an unfinished width "$w_{uf}$."

Figure 8B:
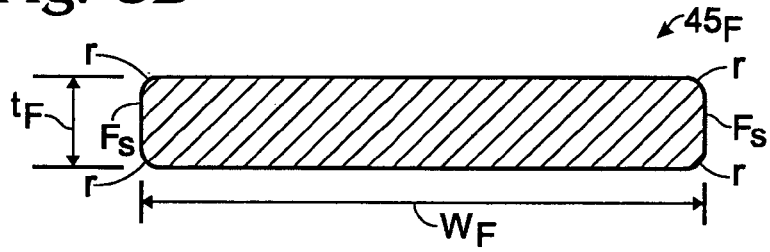
FIG. 8B is a cross-sectional view of the article of lumber of FIG. 8A in a finished condition.

FIG. 8B shows a cross-section of the article of lumber shown in FIG. 7A in a finished condition $\mathbf{45}_F$ as a result of cutting two side faces $F_s$, along with four respective radiused corners "r," with planer heads corresponding to 16*c* and 16*d* of FIGS. 1A and 1B. Accordingly, each of the side-cutting planer heads has corner-cutting adaptations for cutting two radiused corners "r" in addition to an adaptation for face-cutting a flat side face $F_s$.

Figure 9A:
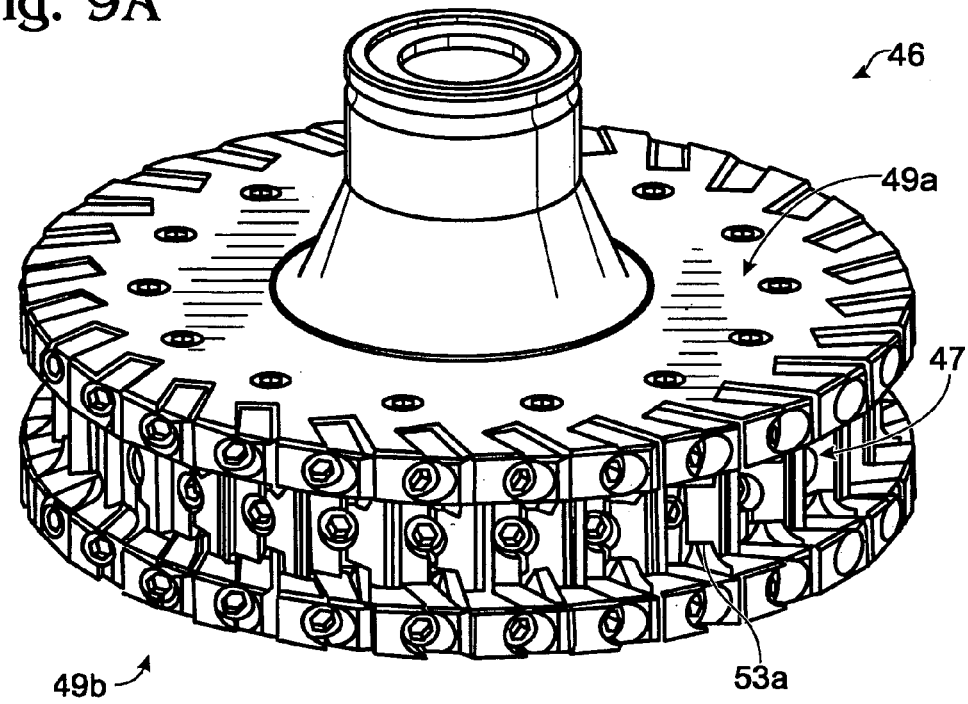
FIG. 9A is a pictorial view of side-cutting planer head according to the present invention.
Figure 9B:
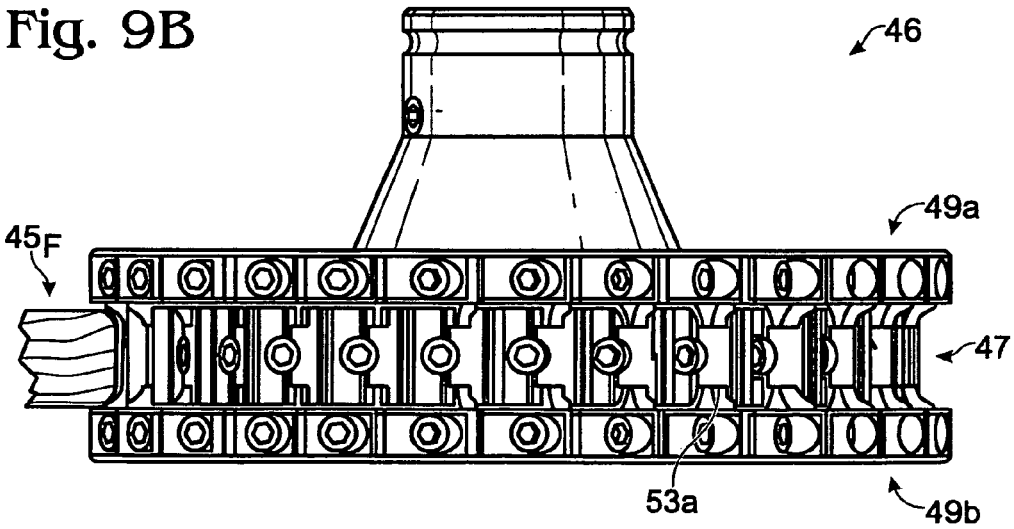
FIG. 9B is a side elevation of the planer head of FIG. 8A.

Turning to FIGS. 9A and 9B, a side-cutting planer head 46 is shown having the corner and face-cutting adaptations just indicated. Particularly, the side-cutting planer head 46 has a face-cutting center portion 47 and two corner-cutting end portions 49*a* and 49*b*, on either side of the center portion 47, for cutting respective radiused corners "r." The portions may be attached to a shaft for rotating the portions as is known in the art or may be formed integrally with the shaft.

Figure 10:
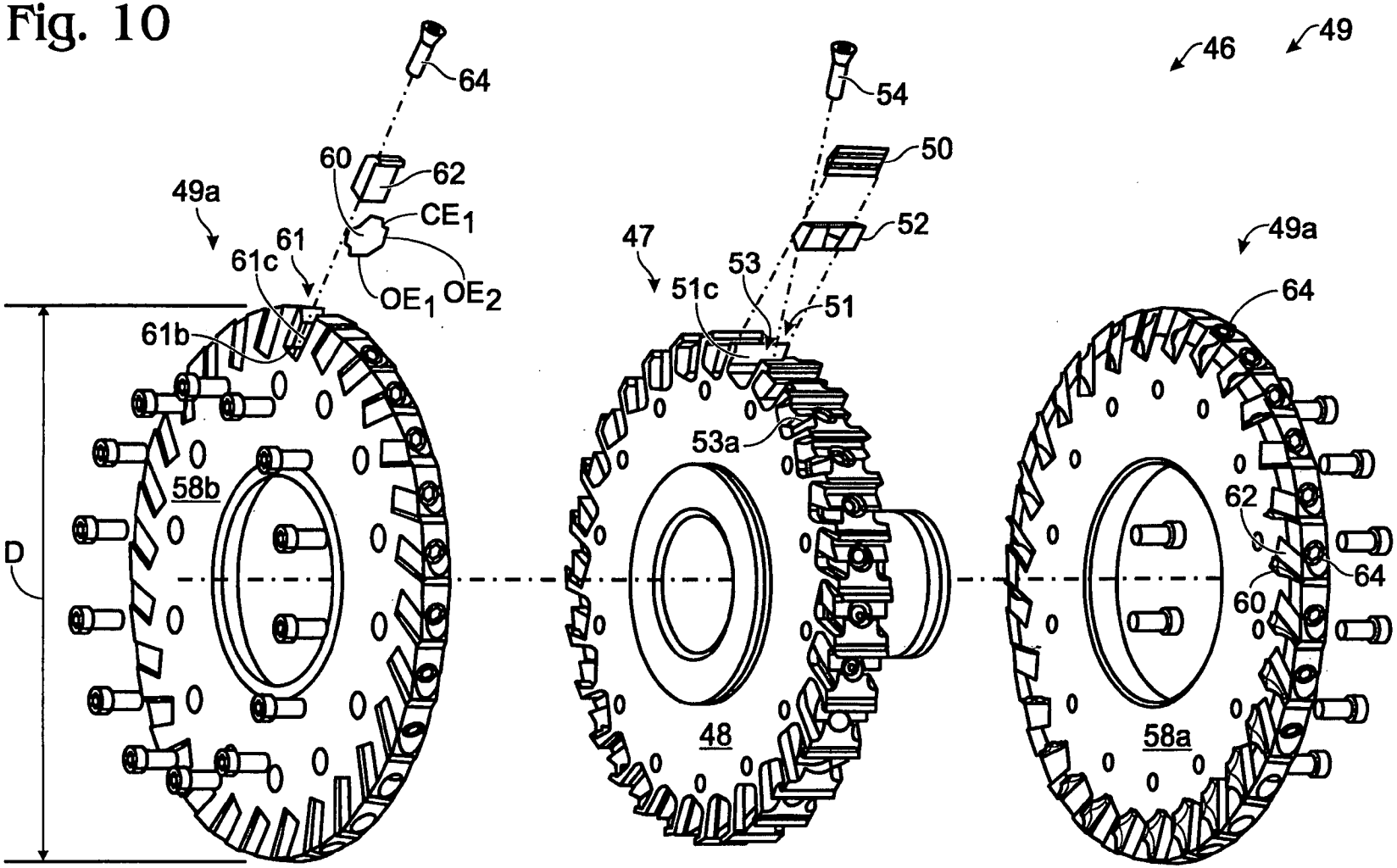
FIG. 10 is an exploded view of a preferred configuration of the planer head of FIG. 8A.

Turning to FIG. 10, the face-cutting center portion 47 includes a hub 48 carrying a plurality of circumferentially spaced apart knives 50. Each knife 50 is disposed in an associated pocket 51 and has an associated gib 52. A screw 54 is threadably received through the hub 48. The screw 54 preferably has the same features as the screw 34 for wedging against the gib 52, and in turn for wedging the knife against a supporting wall 51*c* of the pocket 51. As the center portion 47 is used to cut a flat face like the planer head 26 described above, the center portion is preferably provided with all of the features of the planer head 26.

Figure 11:
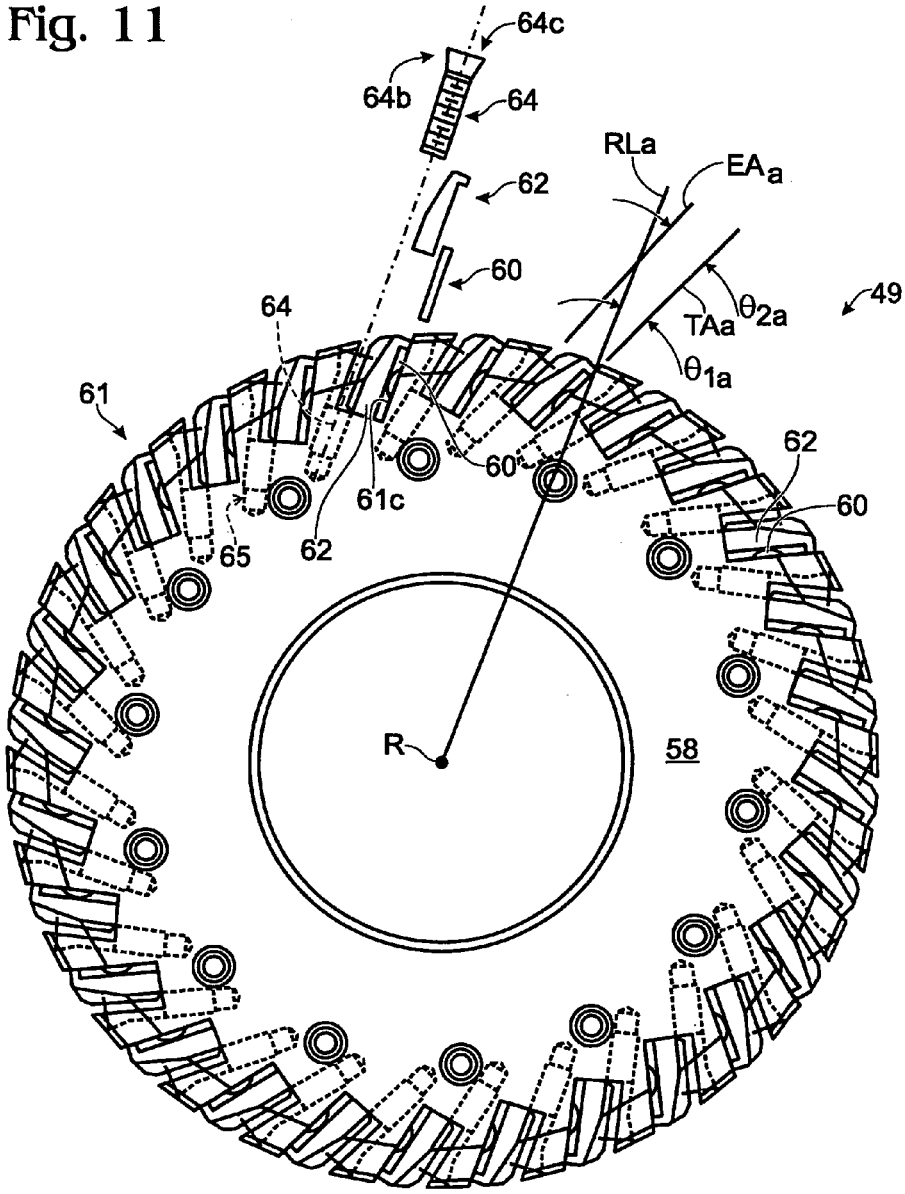
FIG. 11 is an end view of a corner-cutting planer head according to the present invention.

With reference to FIGS. 10 and 11, each corner-cutting end portion 49 includes a hub 58 (58*a*, 58*b* in FIG. 10) carrying a plurality of circumferentially spaced apart knives 60. Each knife 60 is disposed in an associated pocket 61 and has an associated gib 62. A screw 64 is threadably received through the hub. The screw 64 preferably has a ramping shoulder portion 64*b* that is the same as or similar to the ramping shoulder portion 34*b* of the screw 34, for wedging against the gib 62, and in turn for wedging the knife against a supporting wall 61*c* of the pocket 61. The screw 64 is shown with a female tightening member 64*c*; however, as mentioned above, either female or male tightening member may be used.

Figure 12A:
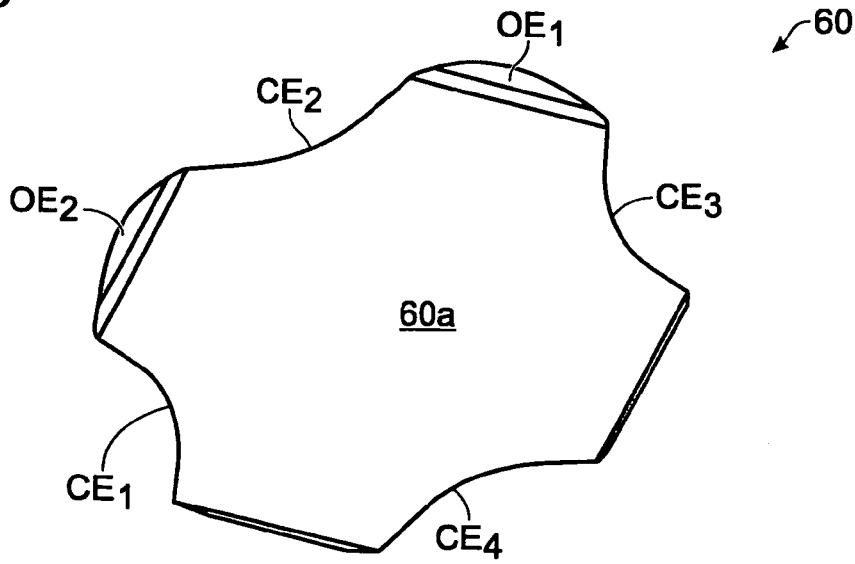
FIG. 12A is a pictorial view of a front side of a corner-cutting knife according to the present invention for use in end portions of the planer head of FIG. 9A.
Figure 12B:
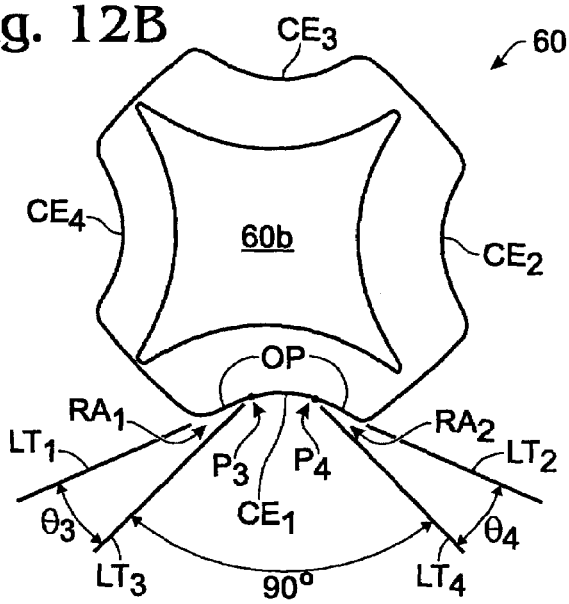
FIG. 12B is a pictorial view of a back side of the knife of FIG. 12A.

As best seen in FIG. 9B, the corner-cutting end portions 49 (49*a*, 49*b*) are adapted to cut two of the radiused corners "r" shown in FIG. 8B. Turning to FIGS. 12A and 12B, showing the knife 60 in more detail, the knife has at least one corner-cutting edge "$CE_1$" for this purpose. It is advantageous, however, to provide the knife 60 with four corner-cutting edges "$CE_1$,""$CE_2$,""$CE_3$," and "$CE_4$," so that the knife carries a multitude of replacement edges and so that a symmetry is provided in the knife so that the knife is suitable for use in either end portion 49. However, any number of corner-cutting edges (or cutting edges) may be provided. Preferably, the four corner-cutting edges are disposed with respect to one another with 90 degree rotational symmetry as shown; generally, it is preferable to provide "n" cuffing edges with 360/n degree rotational symmetry.

The knife 60 has a front side 60*a* (FIG. 12A) and a back side 60*b* (FIG. 12B). Taking the end portion 49*a* for example and with reference to FIG. 9, to expose the corner-cutting edge "$CE_1$," the knife is indexed to the pocket 61 by seating a first outer edge "$OE_1$" against a bottom supporting wall 61*b* in the hub 58*a*. A second outer edge "$OE_2$" is index to a sidewall 53*a* (see also FIGS. 9A and 9B) of a pocket 53 in the adjacent hub 48 of the center portion 47. Similar considerations apply in mirror image for the end portion 49*b*.

With particular reference to FIG. 12B, the cutting edge "CE" is a portion of a concavely circular arc for cutting a round (radiused) corner "r," though other shapes could be used for forming corners having different configurations. A full 90 degree arc, necessary for cutting a complete ¼ round corner "r," is shown superimposed on the cutting edge "$CE_1$" in dotted line. The 90 degree arc terminates at end-points $P_3$ (corresponding to $P_1$) and $P_4$ (corresponding to $P_2$). Tangent lines "$LT_3$" and "$LT_4$" that are tangent to the end-points $P_3$ and $P_4$ are spaced apart 90 degrees.

By contrast, the cutting edge "$CE_1$" is preferably less than a full 90 degree arc and terminates at end-points $P_1$ and $P_2$. Tangent lines "$LT_1$" and "$LT_2$" that are tangent to the end-points $P_1$ and $P_2$ are spaced apart greater than 90 degrees. Particularly, respective alignment relief areas "$RA_1$" and "$RA_2$" are defined between the respective tangent lines "$LT_1$" and "$LT_2$" and the corresponding respective tangent lines "$LT_3$" and "$LT_4$." These alignment relief areas (or "alignment reliefs") are preferably formed by employing, preferably though not necessarily, straight outer perimeter sections "OP" flanking, on each side, the cutting edge "$CE_1$." An alignment relief angle $\theta_3$ corresponding to the alignment relief area "$RA_1$" and an alignment relief angle $\theta_4$ corresponding to the alignment relief area "$RA_2$" are preferably equal to each other and are preferably about 20 degrees; however, the angles can vary depending on need according to the following considerations.

The alignment reliefs are provided to ensure that the knife does not extend into space in which it is not desired as a result of misalignment of the knives. Even if the knives are originally perfectly aligned, such misalignment can subsequently occur, for example, as a result of the process known in the art as "jointing," which is used to sharpen the knives in a planer head with a stone, while the knives remain clamped to the apparatus. Referring to FIGS. 9A and 9B for context, the stone (not shown) contacts the cutting edges of the knife 50 of the center portion 47 and the cutting edges of the knives 60 of the end portions 49 at the same time, and it is highly desirable that the stone be applied to the same thickness of metal for all cutting edges, to provide for even sharpening. However, if the outer perimeter sections of the knives 60 extended along the lines "$LT_3$" and "$LT_4$," and if the knives 60 were not perfectly aligned or oriented with respect to the knives 50, portions of the knives 60 would project into space adjacent to that occupied by portions of the knives 50, "doubling-up" on the amount of metal confronted by the stone at such locations.

Figure 13A:
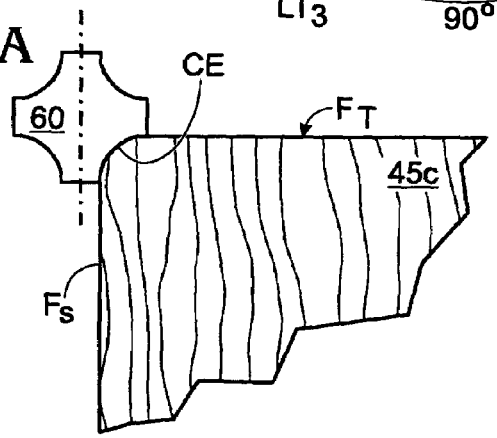
FIG. 13A is a cross-sectional schematic view of an article of lumber being cut with a comer-cutting knife having a full ¼ round cutting edge in perfect alignment.
Figure 13B:
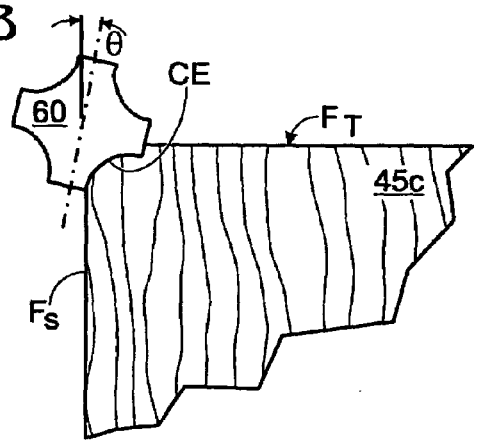
FIG. 13B is a cross-sectional schematic view of the article of lumber of FIG. 12A cut with the knife of FIG. 13A in imperfect alignment.

As another consideration, the alignment reliefs prevent potential interference between the corner-cutting knife 60 and an adjacent face-cutting knife. An example is shown in FIGS. 13A and 13B. FIG. 13A shows a corner portion (in cross-section) of an article of lumber 45*c*. A top face "$F_T$" is cut with a face-cutting planer head (not shown) such as the planer head 26, while a side face "$F_S$" is cut with the face-cutting center portion 47 of planer head (also not shown) adapted for corner cutting such as the planer head 46. A corner-cutting end-portion 49 (also not shown) of the planer head carries a knife 60 having a cutting edge "CE." As shown, the cutting edge "CE" is a full ¼ round and is perfectly aligned with respect to the top face "$F_T$;" however, this is not a practical circumstance.

Turning to FIG. 13B, if the knife 60 is misaligned by any angle θ that is greater than zero, the cutting edge CE will cut into the top face "$F_T$" regardless of whether the top face is cut before or after the side face "$F_S$." If the knife is misaligned in the opposite direction, a similar interference will occur with the side face "$F_S$."

The knives 50 and screws 54 of the center portion 47 of the planer head 46 are preferably oriented as shown in FIG. 10. Referring to FIG. 11, the gib 62 associated with the pocket wall 61*c* defines an orientation of an axis "$TA_a$", in the plane of the back surface 60*a* (FIG. 12A) of the knife 60 as installed in the hub 58. This orientation can be specified as an angle $\theta_{1a}$ relative to a radial line "$RL_a$" extending through the axis of rotation "R" of the head. The angle $\theta_{1a}$ establishes the axis "$TA_a$." The angle $\theta_{1a}$ is optimized to provide a desired angle of attack for the knife and is preferably in the range of10-30 degrees.

A hole 65 for receiving the threaded portion of the screw 34 has an elongate axis "$EA_a$" that makes an angle $\theta_{2a}$ relative to the radial line "$RL_a$." The angle $\theta_{2a}$ is optimized to direct the clamping force against the knife. The angle $\theta_{2a}$ is preferably in the range of 0-20 degrees and is determined without regard to the angle $\theta_{1a}$, i.e., the axes "$EA_a$" and "$TA_a$" rotate together as the angle $\theta_{1a}$ is varied.

The prior art typically provided a single knife having a straight cutting edge integrally formed with one (or two) curved cutting edges, to cut both the side face $F_s$ and one (or two) of the corners r of the article of lumber $\mathbf{45}_F$ in FIG. 8B. The novel construction of the present invention provides a number of outstanding advantages over the prior art. For example, to change the radius of the finished lumber, all that is required according to the invention is to change the relatively small and inexpensive corner-cutting knives 60, while in the prior art, the entire cutting surface needed to be changed.

Moreover, the prior art planer head was adapted for a particular knife. Turning back to FIG. 10, the center and end portions according to the present invention are preferably provided as separate units that are bolted together as shown. Although this feature is not essential and the end portions may be manufactured integrally, the feature provides for changing the width of the finished lumber simply by changing out the center portion 47, while in the prior art, the entire planer head would need to be changed.

According to another aspect of the invention, and taking advantage of the preferred "bolt-together" construction of the planer head 46 shown in FIG. 10, the planer head can be adjusted from being adapted to cut dry lumber to being adapted to cut green lumber, and the reverse, simply by changing the knives 60 and the end portions 49.

Figure 14A:
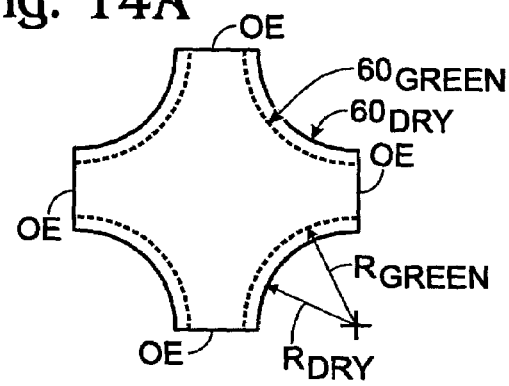
FIG. 14A is a plan view of two knives according to the present invention, comparing dimensions thereof for cutting an article of lumber from dry and green stock.

FIG. 14A shows the outline of a representative knife $\mathbf{60}_{DRY}$, corresponding to the configuration shown in FIG. 12A, for cutting an article of lumber of nominal size from stock that has been kiln dried. The cutting edges $CE_{DRY}$ have respective radii $R_{DRY}$. Shown in dotted line is the outline of a corresponding knife $\mathbf{60}_{GREEN}$ having larger respective radii $R_{GREEN}$ adapted for cutting the same article of lumber from green stock.

Figure 14B:
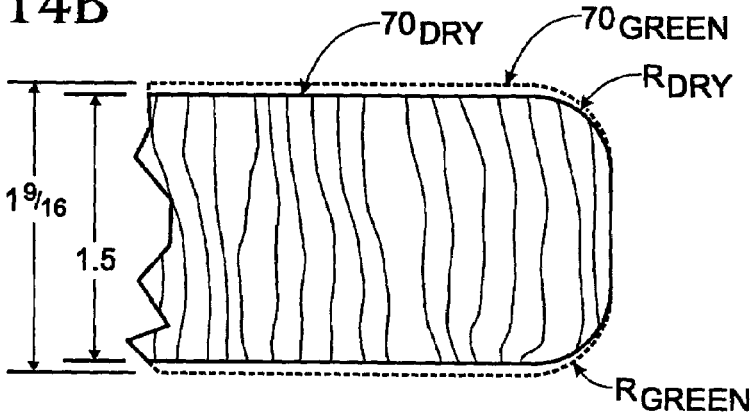
FIG. 14B is an end view of an article of lumber shown with finished corners produced by the two knives of FIG. 14A.

FIG. 14B shows an of a finished 2×4 $\mathbf{70}_{DRY}$ finished from dry stock, corresponding to the outline shown for the article $\mathbf{45}_F$ in FIG. 9B, along with the corresponding outline of a 2×4 $\mathbf{70}_{GREEN}$ finished from green stock shown in dotted line. The widths of the two articles differ slightly, typically by the dimensions indicated, and the radii of the respective corners $R_{DRY}$ and $R_{GREEN}$ differ as shown FIG. 14A.

Figure 14C:
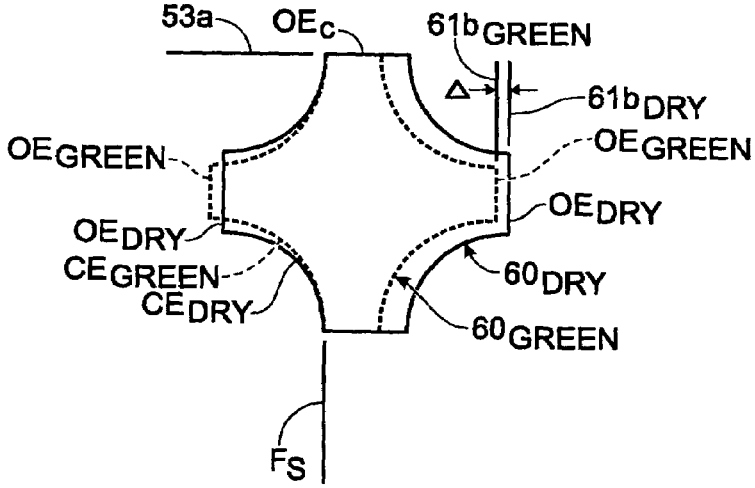
FIG. 14C is a plan view of a positioning, according to the present invention, of the two knives of FIG. 14A for finishing the article of lumber as shown in FIG. 14B.

With additional reference to FIG. 10, it is recognized that to leave the outer edges OE (FIG. 14A) of the knives 60 available for indexing to the center portion 47 (particularly, the sidewall 53*a*) as described above, the knives $\mathbf{60}_{DRY}$ and $\mathbf{60}_{GREEN}$ can be shifted relative to one another as shown in FIG. 14C (compare with FIG. 14A). Outer edges OE of both knives remain positioned to contact the sidewall 53*a* (FIG. 10) of the center portion 47, so that the same center portion can be used. Outer edges $OE_{DRY}$ and $OE_{GREEN}$ are shifted relative to one another, and this shift can be accommodated by modification of the end portions 49.

For example, to cut 2×4's from dry stock, the knife $\mathbf{60}_{DRY}$ has the position shown in FIG. 14C: A cutting edge $CE_{DRY}$ merges or aligns with the face side $F_s$ of the 2×4; the knife $\mathbf{60}_{DRY}$ is indexed to the sidewall 53*a* of the center portion 47 at the outer edge $OE_C$; the knife $\mathbf{60}_{DRY}$ is indexed to the bottom supporting wall 61*b* of the pocket 61 of the end portion 49 (49*a* in FIGS. 9B and 10) at the outer edge $OE_{DRY}$. Similarly, to cut 2×4's from green stock, the knife $\mathbf{60}_{GREEN}$ has the position shown in FIG. 14C. A cutting edge $CE_{GREEN}$ merges or aligns with the face side $F_S$ of the 2×4, the knife $\mathbf{60}_{GREEN}$ is indexed to the sidewall 53*a* at the outer edge $OE_C$, and is indexed to the bottom supporting wall 61*b* at the outer edge $OE_{GREEN}$. The outer edges $OE_{DRY}$ and $OE_{GREEN}$ are displaced an amount Δ from one another that is equal to ½ the difference in the widths shown in FIG. 14B, and the respective depths of the pockets 61 of end portions 49 corresponding to the two knives are provided accordingly.

Preferably, the pockets 61 are identical for end portions adapted for the two types of wood stock, and the depths of the pockets are adjusted simply by changing the outer diameter "D" of the end portion (see FIG. 10), though this is not essential. In any event, to change from cutting green lumber to dry lumber or the reverse, or to change the width of the article of lumber a small amount for any other reason, only the knives 60 and the end portions 49 need to be changed; the more expensive center portion 47 may be used for either purpose and therefore may remain in the cutting apparatus.

Figure 15A:
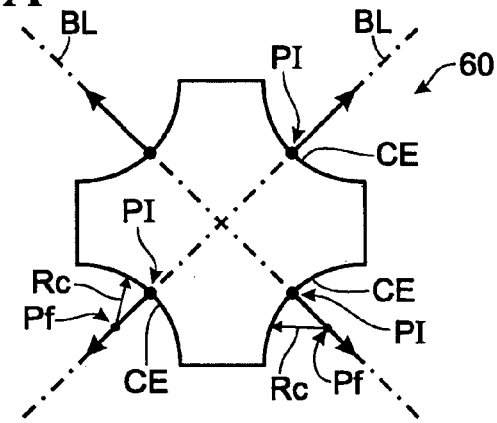
FIG. 15A is a schematic view of the knife of FIGS. 12A and 12B showing geometric constructions useful for defining the configuration of the knife according to the present invention.
Figure 15B:
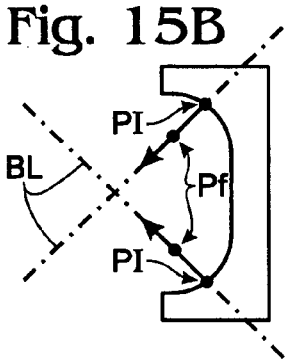
FIG. 15B is a schematic view of a prior art knife corresponding to the schematic view of FIG. 15A.

Turning to FIG. 15A, the knife 60 has a distinct configuration that can be defined with reference to lines "BL" that bisect the cutting edges CE of the knife. Each cutting edge CE is preferably semi-circular as described above and, therefore, has a radius of curvature Rc that is constant. The radii of curvature extend from respective focal points Pf that lie on the lines BL. The lines BL intersect the cutting edges at respective points PI , and vectors extending along the lines BL in the direction from the points PI to the points Pf diverge from another as shown, i.e., they do not cross one another. FIG. 15B provides a comparison with a prior art knife having two curvilinear cutting edges. The same principles can apply to distinguish knives 60 having more complex curvilinear shapes for the cutting edges.

Figure 16A:
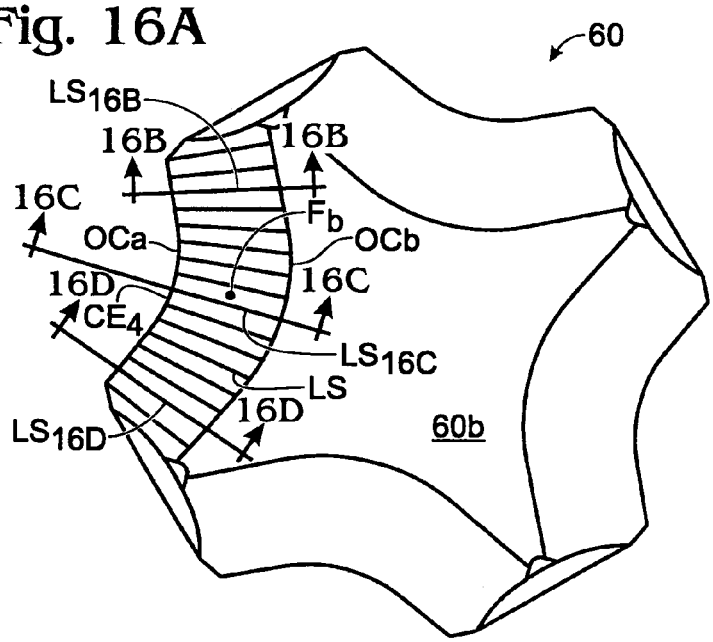
FIG. 16A is a pictorial view of the knife shown in FIGS. 12A and 12B showing line segments used to describe the shape of a beveled surface of the knife according to the present invention.
Figure 16B:
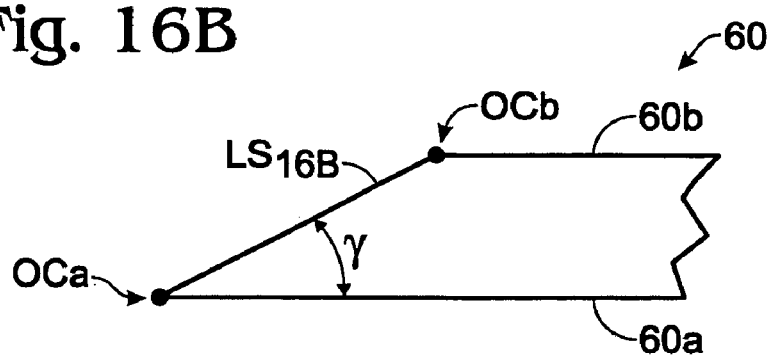
FIG. 16B is a partially cut-away cross-sectional view of the knife of FIG. 16A taken along a line 16B-16B thereof.
Figure 16C:
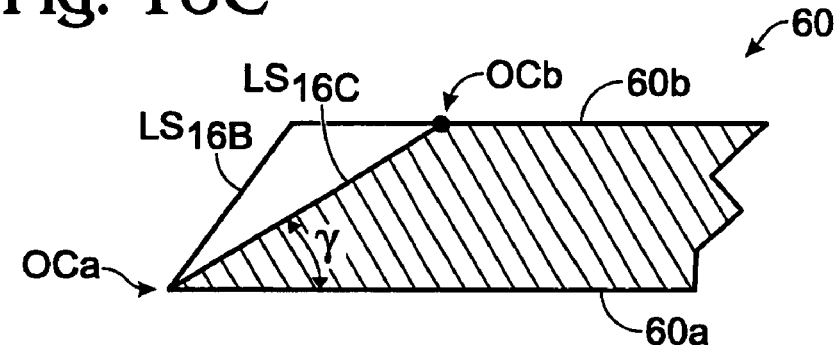
FIG. 16C is a partially cut-away cross-sectional view of the knife of FIG. 16A taken along a line 16C-16C thereof.

FIGS. 16A-16C illustrate another aspect of the knife 60 according to the present invention. As seen in FIG. 16A, a number of line segments "LS" are shown on a beveled face "Fb" that includes the cutting edge $CE_4$ shown in FIG. 12B. The line segments "LS" are lines perpendicular to both an outer peripheral contour "OCa" that defines a periphery of the front surface 60*a* of the knife (not visible in FIG. 16A-*see* FIG. 12A) that includes the cutting edge "$CE_4$" and a corresponding, parallel outer peripheral contour "OCb" that defines a periphery of the back surface 60*b* of the knife. The line segments "LS" are therefore of minimum length for connecting the two outer contours. As the line segments "LS" are geometric constructions rather than distinct physical features, there are an infinite number of the line segments "LS" defining the beveled face "Fb."

Figure 16D:
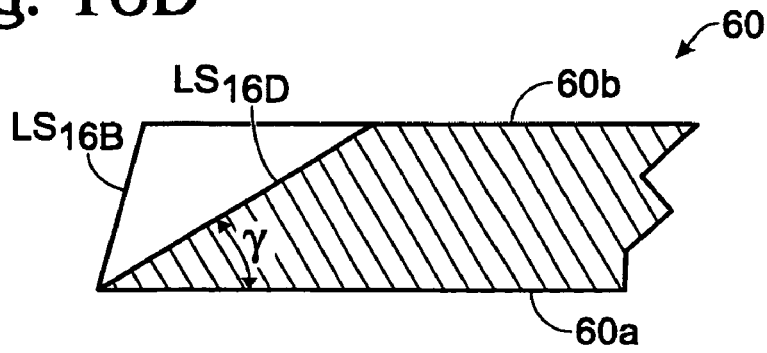
FIG. 16D is a partially cut-away cross-sectional view of the knife of FIG. 16A taken along a line 16D-16D thereof.

FIGS. 16B-16D are cross-sections of the knife 60. Each cross-section is taken in a plane perpendicular to (a) the front surface 60*a*, (b) the parallel back surface 60*b*, and (c) the respective outer contours "OCa" and "OCb," and includes one of the line segments "LS." Particularly, FIG. 16B illustrates the cross-section indicated in FIG. 16A that includes the line segment "$LS_{15B}$," FIG. 16C illustrates the cross-section indicated in FIG. 16A that includes the line segment "$LS_{15C}$," and FIG. 16D illustrates the cross-section indicated in FIG. 16A that includes the line segment "$LS_{15D}$."

Each of these line segments is angled, as are all of the line segments "LS," with respect to the plane of the front side 60*a* of the knife, by a substantially fixed angle γ that is preferably in the range of 25-40 degrees. The angle γ is referred to herein as an "attack relief angle" to distinguish it from the alignment relief angle described earlier. As can be seen in FIG. 16B for example, the attack relief angle γ is defined between the line seaments LS and the undersurface 60*a* (FIG. 12A) of the knife.

Figure 17A:
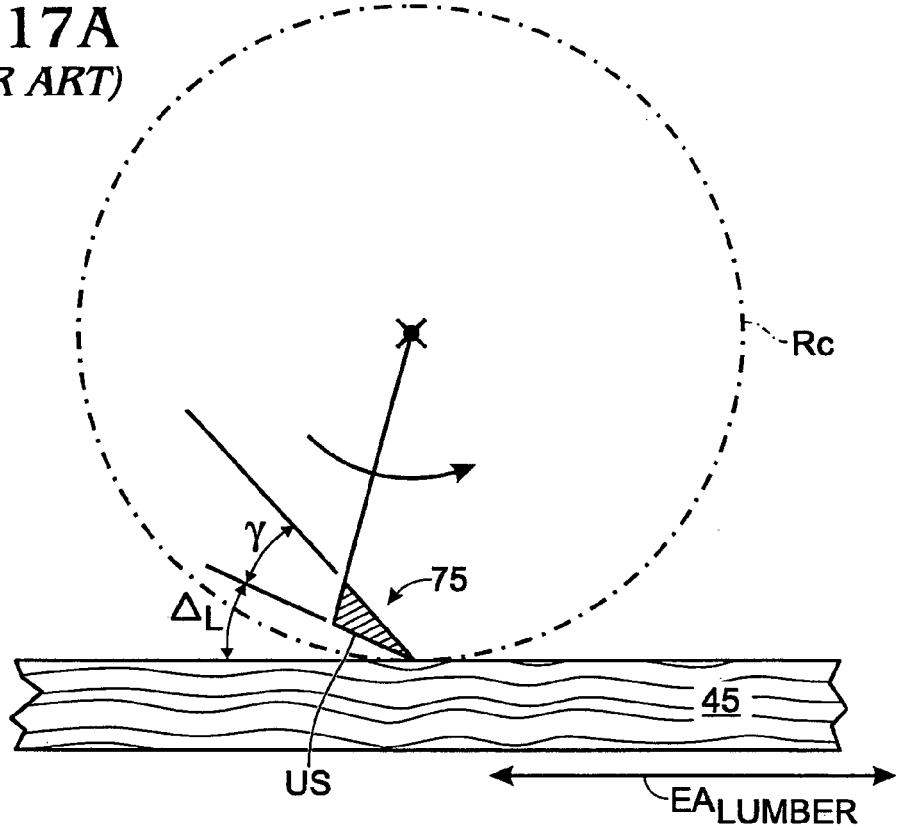
Fig. 17A (PRIOR ART)
FIG. 17A is a schematic view of a face-cutting knife cutting an article of lumber showing an attack-relief angle according to the prior art.

Referring to FIG. 17A, a schematic drawing of an elongate article of lumber 45 is shown being cut or chipped by a knife 75 rotating in the direction indicated and defining a cutting "Rc." The knife 75 corresponds to the face-cutting knife 50 of the center portion 47 of the planer head 46 shown in FIG. 10. The article 45 extends along an elongate axis "$EA_{LUMBER}$." An angle $\Delta_L$ with respect to the elongate axis having some nonzero magnitude must be provided to avoid hammering the wood with an undersurface "US" (or 60*a* in FIG. 12A) of the knife 75. Such hammering deleteriously affects the surface finish provided by the knife.

Figure 17B:
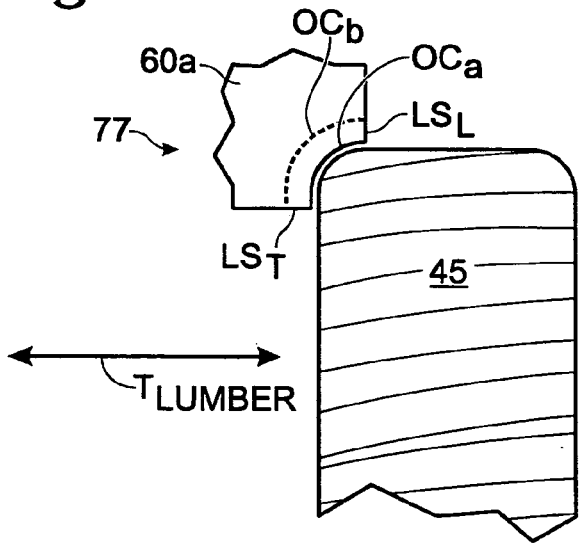
FIG. 17B is a schematic view of a corner-cutting knife according to the present invention shown relative to the article of lumber of FIG. 17A.

FIG. 17B views the article of wood shown in FIG. 17A from a direction perpendicular to the axis "$EA_{LUMBER}$." The knife 75 is omitted, but a corner-cutting knife 77 according to the present invention is shown. The knife 77 has a front side 60*a* and two outer contours OCa and OCb as described above. The line segment "$LS_L$" in FIG. 17B corresponds to the line segment "$LS_{16B}$" in FIG. 16B and, therefore, provides an attack relief angle γ as shown in FIG. 16B. Thence, line segments LS are provided by the knife 77 in the longitudinal direction, i.e., the direction of "$EA_{LUMBER}$."

An outstanding advantage of the knife 77 is that the knife 77 also provides line segments LS oriented in the transverse direction "$T_{LUMBER}$." Particularly, the line segment "$LS_T$" shown in FIG. 17B corresponds to the line segment"$LS_{16D}$" in FIG. 16D and, therefore, provides an attack relief angle γ as shown in FIG. 16D. Moreover, according to the present invention, the knife 77 provides an attack relief angle of γ in every and all intermediate directions. In the preferred embodiment of the invention the attack relief angle is constant over the surface "Fb" (FIG. 16A) as mentioned above; however, this is not essential.

The curvilinear knife 77 according to the present invention is provided independent of the corresponding face-cutting, linear knife and it is therefore relatively easy to provide an optimally configured surface Fb. For example, it is relatively easy to manufacture the knife 77 with a constant attack angle of relief over the entire surface Fb. Moreover, because the curvilinear knives are staggered with respect to the corresponding face-cutting knives so that their cutting surfaces overlap, jointing the knives does not increase the width of the cut or cause surface imperfections such as lines at the apparent points of joinder of the respective cutting surfaces.

It is to be recognized that, while a particular high speed planer head has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A wood-cutting knife comprising at least two spaced apart, concavely curvilinear cutting edges, wherein respective lines bisecting said cutting edges extending from respective points of intersection therewith to respective centers of curvature thereof diverge from one another, the knife having a planar front side, a spaced apart, planar back side and a beveled face connecting said front and back sides at respective outer peripheral contours thereof, wherein the outer peripheral contour of said front side includes one of said cutting edges, wherein, in a cross-section of the knife taken in a plane perpendicular to the plane of said front side and to the peripheral outer contour of said front side, said beveled face defines an attack relief angle with respect to said plane, wherein said attack relief angle is in the range of 25-40 degrees.

2. The knife of claim 1, wherein said cutting edges are semi-circular.

3. The knife of claim 2, wherein said attack relief angle is constant over said beveled face.

4. The knife of claim 1, wherein said attack relief angle is constant over said beveled face.

5. The knife of claim 4 including, associated with at least one of said cutting edges, substantially linear outer perimeter portions that provide respective alignment reliefs with respect to lines tangent to the ends of said at least one of said cutting edges.

6. The knife of claim 5, wherein said reliefs define alignment angles of relief between said lines and said outer perimeter portions that are at least about 20 degrees.

7. The knife of claim 6 having four spaced apart, concave semi-circular cutting edges.

8. The knife of claim 7, wherein said cutting edges are spaced apart from one another with 90 degree rotational symmetry.

9. The knife of claim 1 including, associated with at least one of said cutting edges, substantially linear outer perimeter portions that provide respective alignment reliefs with respect to lines tangent to the ends of said at least one of said cutting edges.

10. The knife of claim 9, wherein said reliefs define alignment angles of relief between said lines and said outer perimeter portions that are at least about 20 degrees.

11. The knife of claim 10, having four spaced apart, concave semi-circular cutting edges.

12. The knife of claim 11, wherein said cutting edges are spaced apart from one another with 90 degree rotational symmetry.

13. A wood-cutting knife comprising "n" curvilinear cutting edges, where "n" is greater than 2, spaced apart from one another with 360/n degree rotational symmetry, the knife having a planar front side, a spaced apart, planar back side and a beveled face connecting said front and back sides at respective outer peripheral contours thereof, wherein the outer peripheral contour of said front side includes one of said cutting edges, wherein, in a cross-section of the knife taken in a plane perpendicular to the plane of said front side and to the peripheral outer contour of said front side, said beveled face defines an attack relief angle with respect to said plane, wherein said attack relief angle is in the range of 25-40 degrees.

14. The knife of claim 13, wherein said cutting edges are concave and semi-circular.

15. The knife of claim 14, where "n" =4.

16. The knife of claim 15 including, associated with at least one of said cutting edges, substantially linear outer perimeter portions that provide respective alignment reliefs with respect to lines tangent to the ends of said at least one of said cutting edges.

17. The knife of claim 16, wherein said reliefs define alignment angles of relief between said lines and said outer perimeter portions that are at least about 20 degrees.

18. The knife of claim 13 including, associated with at least one of said cutting edges, substantially linear outer perimeter portions that provide respective alignment reliefs with respect to lines tangent to the ends of said at least one of said cutting edges.

19. The knife of claim 18, wherein said reliefs define alignment angles of relief between said lines and said outer perimeter portions that are at least about 20 degrees.

* * * * *